US006092960A

United States Patent [19]

McCallion

[11] Patent Number: 6,092,960

[45] Date of Patent: Jul. 25, 2000

[54] CONCRETE JOINT RESTRAINT SYSTEM

[76] Inventor: James P. McCallion, 23352 Saint Elena, Mission Viejo, Calif. 92691

[21] Appl. No.: 09/179,734

[22] Filed: Oct. 27, 1998

Related U.S. Application Data

[60] Provisional application No. 60/063,510, Oct. 27, 1997.

[51] Int. Cl.[7] ..... E01C 11/16

[52] U.S. Cl. ..... 404/70; 404/62

[58] Field of Search ..... 404/70, 134, 135, 404/136, 62; 403/397, 398, 388

[56] References Cited

U.S. PATENT DOCUMENTS

| | | | |
|---|---|---|---|
| 1,880,710 | 10/1932 | Bitney | 404/136 |
| 2,133,553 | 10/1938 | Lord | 404/135 |
| 2,439,428 | 4/1948 | Hillberg | 404/62 |
| 2,627,793 | 2/1953 | White | 404/62 |
| 3,033,087 | 5/1962 | Hillberg | 404/62 |
| 3,045,564 | 7/1962 | Crone | 404/62 |
| 3,059,553 | 10/1962 | Woolley | 404/62 |
| 3,114,221 | 12/1963 | Eriksson | 404/136 |
| 5,678,952 | 10/1997 | Shaw et al. | 404/136 |
| 5,791,816 | 8/1998 | McCallion | 404/136 |

OTHER PUBLICATIONS

Concrete Pavement Joints, T 5040.30, Nov. 30, 1990, U.S. Department of Transportation, Federal Highway Administration.

*Primary Examiner*—Thomas B. Will
*Assistant Examiner*—Kristine M. Markovich
*Attorney, Agent, or Firm*—Myers, Dawes & Andras LLP

[57] ABSTRACT

A concrete joint restraint system that is adapted for securing a dowel to first and second horizontal members that are spaced apart from one another and located at a desired height above a subgrade prior to placement of concrete. The system includes a closed clip including a cylinder with an end aperture for receiving one end of the dowel and a snap-on connection for connecting the open clip to the first horizontal member. The system further includes an open clip including a pair of flexible, arcuate side walls that define an elongated gap for receiving the other end of the dowel and a snap-on connection for coupling the closed clip to the second horizontal member. The system beneficially permits plastic, fiberglass reinforced plastic, or other non-metallic dowels to be supported between inexpensive rebar bolsters made of steel wire.

38 Claims, 3 Drawing Sheets

70
78
82
25
85
26
86
21
84
24
81
40
70
80
21
25
22
22
26
24
20

CONCRETE JOINT RESTRAINT SYSTEM

This application claims benefit to U.S. Provisional application Ser. No. 60/063,510 filed Oct. 27, 1997.

BACKGROUND OF THE INVENTION

1. Field of the Invention

The invention relates generally to pavement or slab construction and, more specifically, to a concrete joint restraint system for securely supporting dowels of any material between concrete reinforcing bar "bolsters" (used primarily to support spaced layers of rebar on top of one another) and are also known to the construction art as concrete reinforcing bar supports, or "high chairs", the concrete joint restraint system being for use in jointed pavement construction as well as various other jointed concrete applications.

2. Description of Related Art

The present invention pertains to improvements in the field of pavement construction such as those designed for highway transportation. It is well known that concrete has a comparatively high compressive strength, a comparatively low tensile and shear strength, and that concrete expands and contracts due to changes in temperature. Because highways can experience large temperature changes over the course of a calendar year, accommodations must be made for the resulting changes in the concrete. For example, winter temperatures may cause the concrete to experience subzero temperatures, while the same concrete may be exposed to temperatures of over 100° F. in the summer. The thermal expansion and contraction of the concrete under these conditions can prove destructive, leading to cracking and surface discontinuities if the proper precautions and measures are not taken. In addition concrete will crack naturally, as a result of the curing process, which takes place from the time of placement of the fluid concrete material, until full design strength is achieved. This occurs usually within one month after initial placement of the concrete.

Engineers have found that a series of concrete blocks or slabs positioned with a gap to relieve the stresses in the blocks at the maximum expansion anticipated provides the best solution to these problems. Joints or spacing in between the blocks are necessary to accommodate thermal expansion and contraction of the concrete due to changes in the environmental temperatures, and strategic placement of the joints assist engineers in controlling the direction of the expansion and predicting the location where the concrete will crack as a result of the curing process.

The use of discrete blocks, however, is not without its own problems. Uneven expansion or contraction of the individual blocks can result in discontinuities in the highway which, in turn, can lead to unsatisfactory road conditions as well as stress and fatigue in the individual blocks. Blocks can shift up to create unsafe road conditions and reduce the life of the road. To solve this problem, the construction of concrete pavements have for a long time used dowel bar inserts as load transfer mechanisms. As early as 1917, dowel bars have been used to transfer shear loads at joints in the concrete blocks which make up the pavement. Dowels placed longitudinally in the blocks allow the concrete blocks, or slabs, to expand in the longitudinal direction but resist expansion in the traverse direction of the dowels. By controlling the direction of the expansion of the slabs, engineers can prevent the driving surface of the pavement from becoming discontinuous and uneven.

Previously, steel dowels were the exclusive material used for the joint restraint of the concrete. Steel dowels are relatively cost effective and provide the necessary strength required by this application. However, steel dowels have a corrosive tendency when exposed to the harsh environments of the highway, such as salt, oil, dirt, and moisture which seeps between the joints and attacks the dowels. Corrosion results in the dowel binding because the concrete can no longer expand along the dowels, which severely reduces the load transfer efficiency and can also result in the failure of the dowel if the stresses become large enough.

Various dowel protective coatings have been used to prevent corrosion at the dowel-concrete interface. In addition to preventing corrosion, coatings promote movement in the longitudinal direction which increases the load transfer efficiency. The ideal coating would have a low coefficient of friction with the concrete and a high resistance to corrosion, be safe to work with, and be economical. Both powders and epoxy resins have been used with some success in the art, but no ideal coating has been found to date. The biggest problem is that the most effective coatings are often times harmful to the environment or fail to meet strict code requirements.

The industry has used so-called insertion machines that literally press dowels into wet concrete along the intended joint line. Steel bars, however, have a relatively heavy unit weight (e.g. about 600 lbs. per cubic foot) such that the dowels tends to sink into the concrete if placed there with an insertion machine.

Consequently, the industry often uses so-called "dowel baskets" comprised of cane legs, runners and welded dowels to position the dowel bars at the desired height prior to placement of the concrete, for either a slab/pavement expansion or contraction situation, as determined by design. For pavement construction, slab/pavement subgrade is accurately graded and a basket or cage is placed on the subgrade. The dowel bars are in parallel alignment and form a part of the dowel basket and are thus affirmatively held at the desired height and location when the concrete is placed in position. The dowels are preferably positioned so that the midpoint of the dowel lies at the joint or juncture of two adjacent slabs of concrete at the midpoint of the slab vertical dimension. In this manner the slabs are permitted to move horizontally in the longitudinal direction of the dowels into the gap provided for at the joint, but vertical or lateral movement of the slabs is restrained. Whatever method is used to insert the steel dowels, the problem of corrosion remains.

Fiberglass dowel bars and Fiber Composite (FC) dowels have been recently tested in laboratories to replace the steel dowel bars. Fiberglass dowels are much less susceptible to corrosion than the steel counterparts and, thus, they do not require coatings which can be harmful to the environment. The current cost of fiberglass dowel bars can exceed the cost of steel dowels. Aside from the cost considerations, Fiberglass Reinforced Polymer (FRP) dowels have been shown to compare favorably with steel bars in terms of performance.

FRP dowels are desirable because they eliminate most corrosion issues. There have been a number of attempts to secure FRP dowels to steel baskets using spring clips, plastic tie devices. All of the known methods, however, have drawbacks. For example, they often do not grip the FRP material securely; the dowel assemblies cannot be assembled in a factory and shipped to the jobsite without unacceptable transit damage; and they are likely to be damaged during installation or during concrete placement. The FRP dowels assembled into dowel assemblies using the prior methods tend be become loose and misaligned.

There remains a need, therefore, for a concrete joint restraint system or dowel bar assembly which can effectively secure dowels of any material to bolsters made of any material including, specifically, the ability of securing FRP dowels to steel wire bolsters.

SUMMARY OF THE INVENTION

It is an object of the invention to provide a means to attach any size dowels, made of any material to mechanisms commonly known as bolsters, to form dowel assemblies.

It is a further object of the present invention to form dowel assemblies by providing a means to attach any size dowels, made of any non-ferrous material, such as plastic, fiberglass reinforced polymer, or such, to mechanisms made of ferrous materials, such as steel, to form dowel assemblies and It is a further object of the present invention to provide a means to attach any size dowels, made of any metallic material, such as steel, or such, to mechanisms made of non-metallic materials, such as plastic, fiberglass reinforced polymer, or such, to form dowel assemblies;

In a first aspect, the invention may be regarded as a concrete joint restraint system comprising first and second horizontal members supported at a desired height and at a desired distance from one another; a dowel; a first clip including means for receiving one end of the dowel and means for connecting to the first horizontal member; and a second clip including means for receiving the other end of the dowel and means for connecting to the second horizontal member. The dowel is preferably, but not necessarily, an FRP dowel to avoid corrosion issues. Preferably, the first clip is a closed clip formed from a cylinder and having an end aperture at one end of the cylinder which receives the dowel and a back stop at the other end of the cylinder and the second clip is an open clip formed from a pair of flexible, arcuate walls that have a gap therebetween.

In a second aspect, the invention may be regarded as a concrete joint restraint system that is adapted for securing a dowel to first and second horizontal members that are spaced apart from one another and located at a desired height above a subgrade prior to placement of concrete comprising a closed clip including means for receiving one end of the dowel including a cylinder with an end aperture at one end thereof and means for connecting to the first horizontal member; and an open clip including means for receiving the other end of the dowel including a pair of flexible, arcuate side walls having a gap therebetween and means for connecting to the second horizontal member.

DETAILED DESCRIPTION OF THE PREFERRED EMBODIMENT

The present invention allows any size dowels, made of any material, to be attached to mechanisms commonly known as bolsters, to form dowel assemblies. This invention, therefore, allows allows FRP dowels to be attached to steel dowel bolsters.

Figure 2:
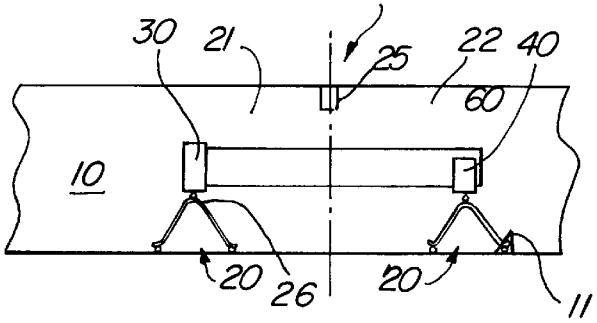
FIG. 2 is a cross-section of the joint movement restraint apparatus of FIG. 1 taken along section lines A-A.
Figure 1:
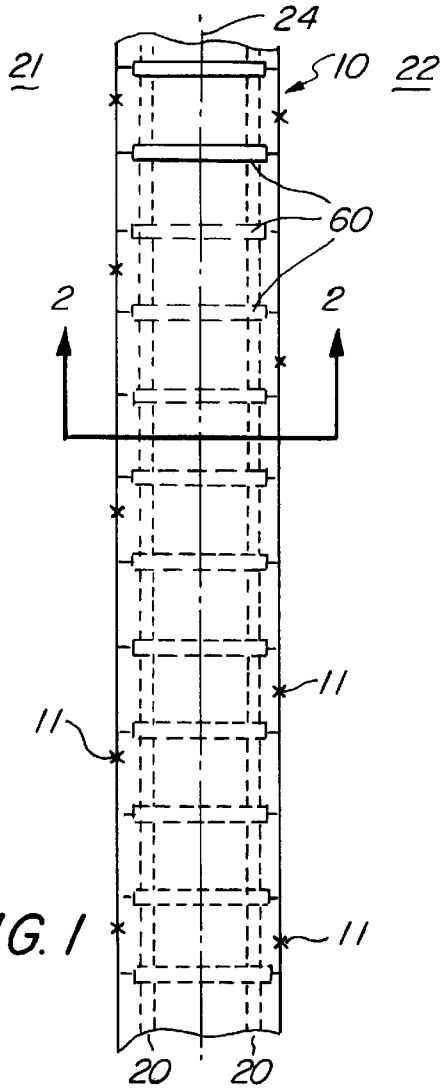
FIG. 1 shows a joint movement restraint apparatus according to the present invention located at the joint between two slabs or blocks.

FIGS. 1 to 2 show a first preferred joint movement restraint apparatus 10 according to the present invention as located along the centerline C/L of a joint 24 between a first section, slab, or block 13 of pavement or other concrete construction and a second section, slab, or block 14 of pavement or other concrete construction. The joint 24 generally comprises a sawed, formed, or tooled groove 25 that creates a weakened vertical plane and regulates the location of cracking 26.

The joint restraint system 10, which may also be called a "dowel assembly," generally comprises a plurality of spaced, parallel dowels 60 that are supported at a desired height, across the joint 24, on and between a spaced pair of elongated supports as is commonly available in "bolsters" 20. The components of the system may be constructed of any material, but the bolsters 20 are commonly available in steel. The bolsters 20, in particular, are formed from wire of varying gauge depending on the desire height. The bolsters 20 are generally secured to the grade with a plurality of fasteners or "hold downs" 11 so that the overall apparatus 10 does not move upon placement of the concrete.

In this particular case, the concrete slab corresponds to a 13' wide section of pavement and the dowels 60, as best shown in FIG. 2, are supported above the subgrade such that the dowels 60 are located at a substantially mid-slab level, i.e. so that a centerline C/L of the dowel 60 is aligned with a centerline C/L of the slab depth. The particular dowels 60 shown have a 1½" diameter, are 18" long, and are arranged in parallel with 12" spacing from centerline to centerline.

FIG. 2 is a cross-section of the apparatus 10 of FIG. 1 and more clearly shows that the dowels 60 are supported between the bolsters 20, 20 with a unique pair of clips—a "closed" clip 30 and an "open" clip 40. The clips 30, 40 beneficially allow a non-metallic dowel such as an Fiberglass Reinforced Polymer (FRP) dowel 60 to be secured to steel bolsters 20 for creation of a "dowel basket" or joint restraint system 10 that is superior in terms of load transfer through improved joint movement and longevity through resistance to corrosion.

Figure 3:
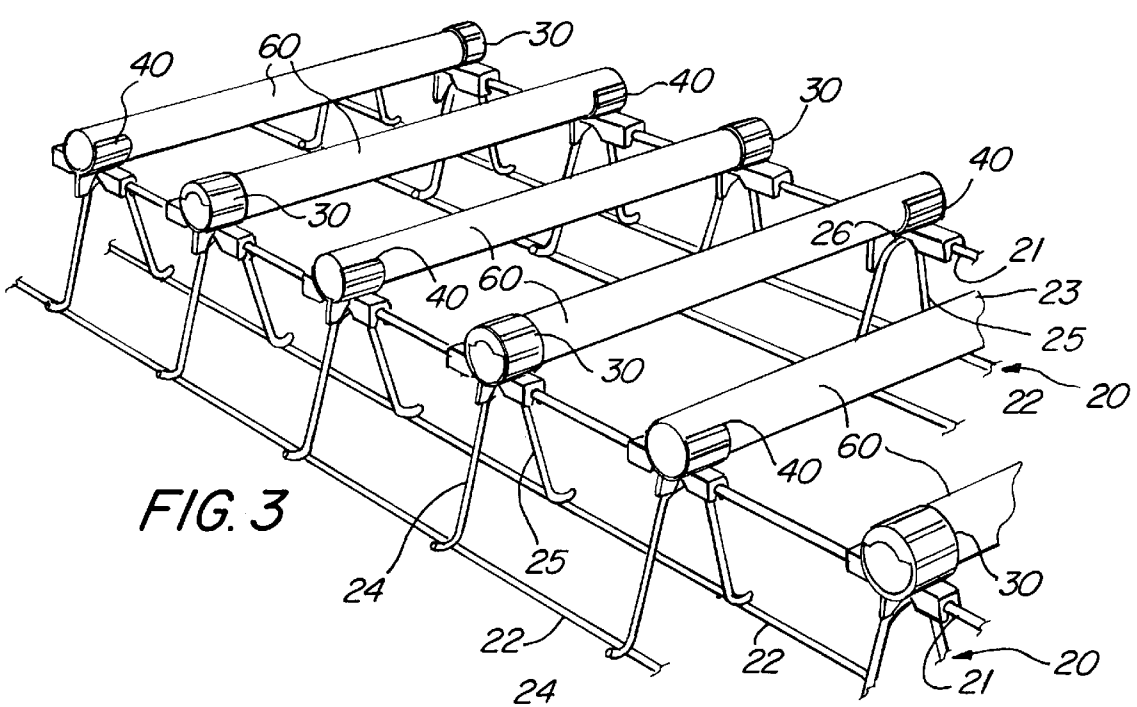
FIG. 3 is a perspective view of the joint movement restraint apparatus of FIG. 1.

FIG. 3 is a perspective view of the preferred joint restraint system 10 used with the contraction joint 24 of FIGS. 1 and 2. As shown here, the preferred system 10 incorporates bolsters 20 of the type that are generally used to support one layer of rebar above another in reinforced slabs. Other vertical supports 20, however, may be used with equal utility. The illustrated bolsters 20, however, generally comprises a horizontal member or upper runner 21 supported at a desired height by a series of spaced, vertical supports 23. The preferred vertical supports 23 comprise a pair of inwardly canted legs 24, 25 which meet below the upper runner 21 at an apex 26 to form an inverted -V. The lower portions of the legs 24, 25 are often connected to a corresponding pair of lower runners 22 as shown, to support the upper runner above a lower layer of rebar. The lower runners 22 may be excluded in some situations (e.g. when supported on rigid materials such as metal decks) or replaced with flat plates in other situations (e.g. when supported on soft materials).

As suggested by FIG. 3, the preferred embodiment of the overall joint restraint system 10 is easily assembled through a series of "snap fit" connections. First, a plurality of clips 30, 40 are secured to the bolsters 20 by pressing them onto the bolsters 20 at the orthogonal intersections of the upper runner 21 and the apex 26 of the vertical supports 23. The clips 30, 40 are preferably arranged in an alternating fashion, as shown, such that one half of the dowels 60 are generally secured to one slab portion 13 but are moveable within the other slab portion 14, and vice versa.

Figure 8:
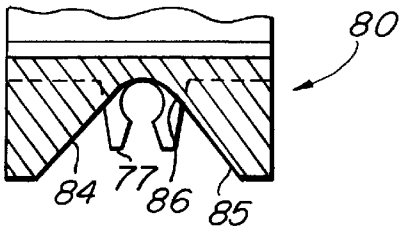
FIG. 8 is a cross-section of the lower portions of the clips of FIGS. 4 and 6 taken along section lines 8—8.
Figure 5:
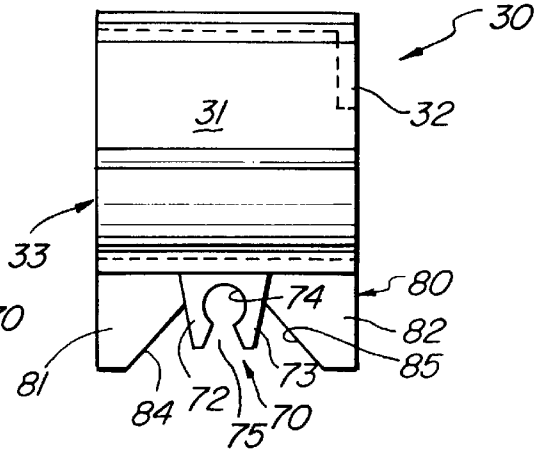
FIG. 5 is a side view of the first closed clip of FIG. 4.
Figure 7:
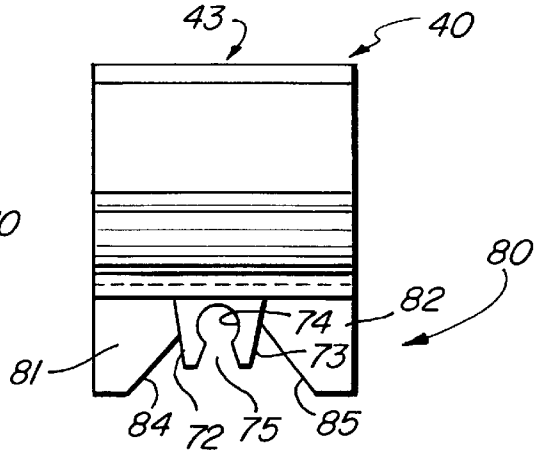
FIG. 7 is a side view of the second open clip of FIG. 6.
Figure 4:
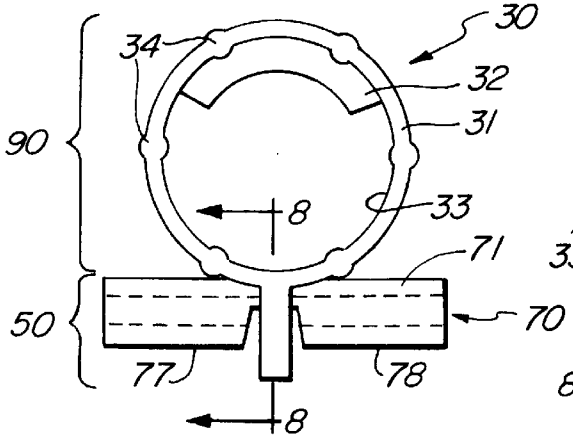
FIG. 4 is an end view of a first closed clip used in the joint movement restraint apparatus.
Figure 6:
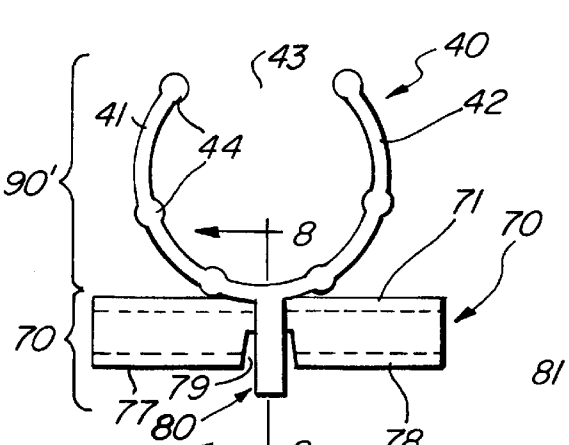
FIG. 6 is an end view of a second open clip used in the joint movement restraint apparatus.

FIGS. 4 to 8 illustrate the construction of the preferred clips 30, 40 in more detail. In particular, FIGS. 4 and 5 show a closed clip 30 (end view and side view), FIGS. 6 and 7 show an open clip 40 (end view and side view), and FIG. 8 shows a cross-section of a lower portion of either clip taken along section lines 8—8.

The closed clip 30 preferably comprises a first means 90 for restraining a dowel 60 and a means 50 for connecting the first restraining means 90 to a bolster 20. Similarly, the open clip 40 preferably comprises a second means 90' for restraining a dowel 60 and an identical means 50 for connecting the second restraining means 90' to a bolster 20.

The first restraining means 90 of the closed clip 30 generally comprises an upper cylinder 31 that defines an end aperture 33 into which a dowel 60 may be inserted until it reaches a back stop 32. The back stop 32 may, of course, be configured other than as shown. The stop, for example, may be in the form of a strap, a fully closed end, a hemisphere, a rim of lesser diameter than the ID of the cylinder, and so on. The back stop 32, moreover, may be removable to form an expansion joint as discussed below. The inside diameter of the end aperture 33 and upper cylinder 31 are sized so as to permit entry of the FRP dowel, or other dowel, while generally securing the dowel from movement after insertion.

The second restraining means 90' of the open clip 40, on the other hand, preferably comprises a pair of arcuate members 41, 42 that define an "open-sided cylinder" with a side gap 43 through which a dowel 60 may be laterally pressed. In both cases, a plurality of compressible ribs 34, 44 are present to grip the dowel 60 that has been inserted. The open clip 40, however, is sized to secure the dowel loosely, permitting dowel/concrete slab movement due to expansion, while effectively restraining vertical movement.

The connecting means 50 may have numerous configurations to mate with available bolsters 20. The preferred connecting means 50, however, comprises a means 70 for gripping the upper runner 21 and a means 80 for stabilizing the clip relative to the legs 24, 25.

The preferred gripping means 70 comprises an elongated gripping member 71 which, as best shown in FIGS. 5 or 7, is formed from a spaced pair of outwardly expandable sides 72, 73 having an entry gap 75 which leads to an internal aperture 74 sized to fit the upper runner 21 of the bolster 20.

The preferred stabilizing means 80 is oriented orthogonal to the gripping means 70 and, as best shown in FIGS. 5 or 7 as well, is formed from a pair of spaced side members of "outriggers" 81, 82 having angled surfaces 84, 85 which, as shown in FIG. 8, meet at an apex 86 in the gap 79 between the two halves 77, 78 of the gripping means 70. As shown in FIGS. 4 and 6, the gripping means 70 is divided into two halves 77, 78 to form a gap 79 that accommodates the apex 26 of the legs 24, 25.

Figures 10, 11:
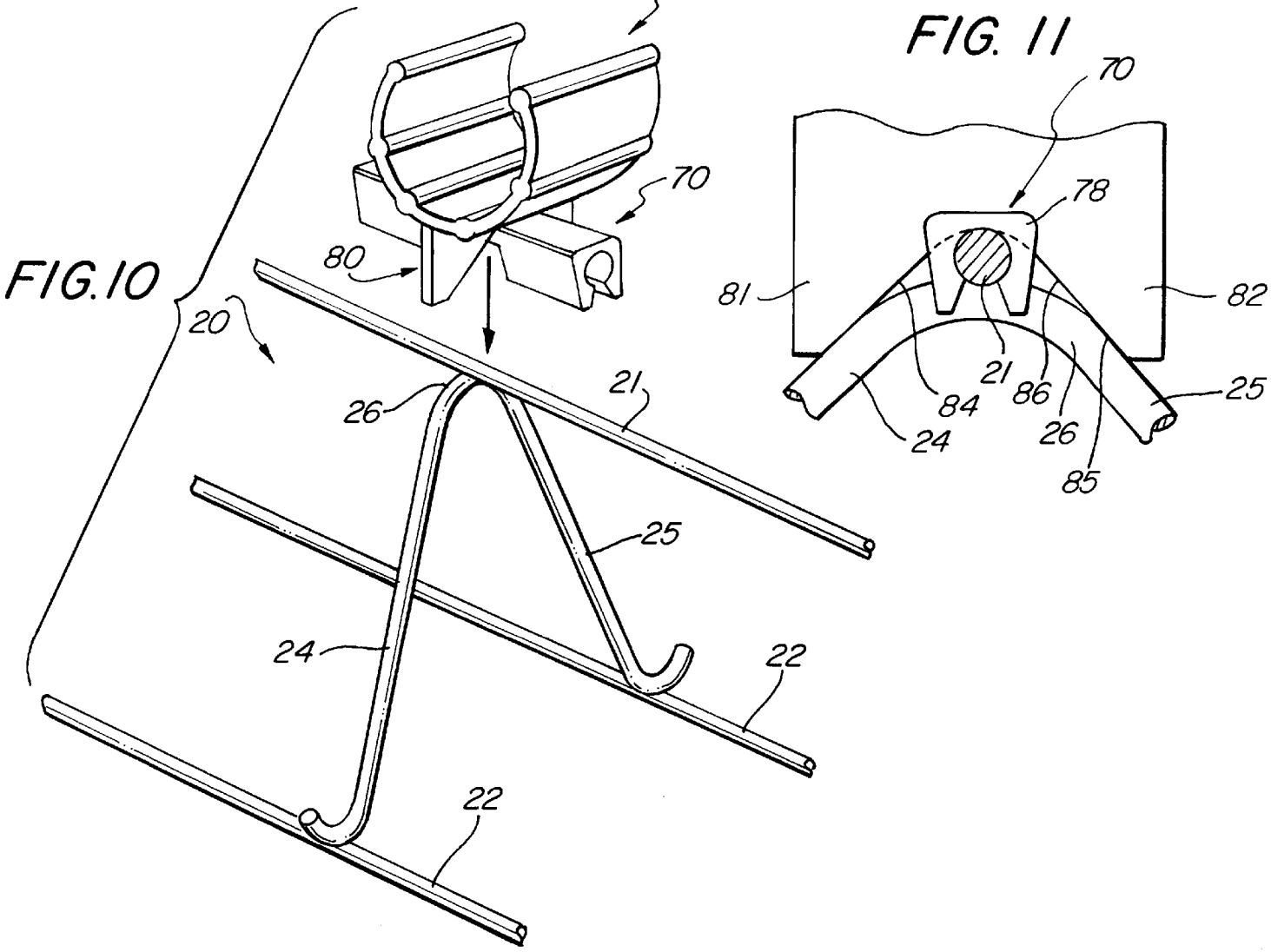
FIG. 10 is a perspective view of an open clip being mounted to a bolster at the intersection of its upper rail one of its legs.
FIG. 11 is a cross-sectional view of the interface between the clip, the upper rail, and the legs when secured together.

FIGS. 10 shows an open clip 40 about to be mounted to a bolster 20 and FIG. 11 shows an end view of the interconnection after they are secured together. As shown in FIG. 10, the clip 40 is pressed onto the bolster 20 with its gripping means 70 aligned with the upper runner 21 and with its stabilizing means 80 aligned with the legs 24, 25 of the vertical support 23. When the gripping means 70 is firmly connected to the upper runner 21, as shown in FIG. 11, the angled surfaces 84, 85 rest snugly against the upper portions of the legs 24, 25 with the apex 26 of the legs received by the apex 86 of the stabilizing means 80.

Figure 9:
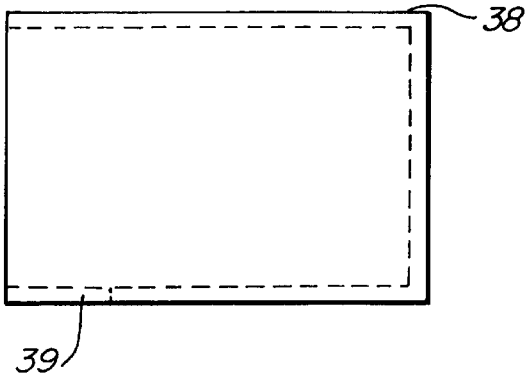
FIG. 9 is a side view of an expansion cap which may be optionally fitted to the closed clip of FIGS. 4 and 5, with or without advance removal of the back stop, to form an expansion joint rather than a contraction joint.

The vast majority of joints 24 are contraction joints. It is a simple matter to modify the joint restraint system 10 of the present invention, however, to provide for an expansion joint. FIG. 9, in particular, illustrates an end cap 38 which may be installed onto a back side of the closed clip 30 of FIG. 5. The end cap 38 includes a notch 39 which surrounds the outrigger 82 when the end cap 38 is pressed onto the clip 30. The end cap 38 creates a void in the concrete into which the dowels may travel to accommodate a desired amount of expansion. During expansion, the dowel 60 would break through the back stop 32 and move into the void defined by the end cap 38. Preferably, however, the back stop 32 would be manually broken out before mounting the end cap 38 in an expansion joint context.

Generally, and most efficiently for handling at the jobsite, the joint restraint system 10 will be totally assembled as shown in FIG. 1. At an offsite manufacturing location, the closed clip 30 would be solvent welded to the FRP dowel bar 60 and the open clip 40 would be mechanically attached to the same FRP dowel bar 60, but with no solvent welded. This subassembly (30, 40, 60) is then attached to the bolster 20 with, preferably, the closed clips 30 being placed to alternate sides of the overall system 10 as shown in FIG. 3. To further stabilize the fully assembled system 10 for shipping, a "shipping strap" (not shown) may be attached across the two bolsters 20, 20, parallel to the dowel, and then removed at the site prior to placement of concrete.

I claim:

1. A concrete joint restraint system comprising:

first and second horizontal members supported at a desired height and at a desired distance from one another;

a dowel;

a first clip including means for receiving one end of the dowel, a stop to limit axial travel of the dowel, and means for connecting to the first horizontal member; and a second clip including means for receiving the other end of the dowel and means for connecting to the second horizontal member.

2. The concrete joint restraint system of claim 1 wherein the dowel is a steel dowel.

3. The concrete joint restraint system of claim 1 wherein the dowel is a non-metallic dowel.

4. The concrete joint restraint system of claim 1 wherein the dowel is an FRP dowel.

5. The concrete joint restraint system of claim 1 wherein the first clip is a closed clip and the second clip is an open clip.

6. The concrete joint restraint system of claim 5 wherein the means for receiving the dowel in the closed clip comprises a cylinder having an end aperture at one end of the cylinder which receives the dowel.

7. The concrete joint restraint system of claim 6 wherein the cylinder includes a means for gripping the dowel.

8. The concrete joint restraint system of claim 7 wherein the gripping means comprises a plurality of compressible ribs.

9. The concrete joint restraint system of claim 6 wherein the stop comprises a back stop disposed at the other end of the cylinder for limiting the travel of the dowel.

10. The concrete joint restraint system of claim 6 further comprising an end cap which connects to the other end of the cylinder to provide an expansion void.

11. The concrete joint restraint system of claim 10 wherein the cylinder has a back stop at the other end thereof for limiting the travel of the dowel.

12. The concrete joint restraint system of claim 11 wherein the back stop is removable.

13. The concrete joint restraint system of claim 11 wherein the back stop breaks out under expansion pressure.

14. The concrete joint restraint system of claim 5 wherein the means for receiving the dowel in the open clip comprises a pair of flexible, arcuate walls that have a gap therebetween.

15. The concrete joint restraint system of claim 14 wherein the arcuate walls include compressible ribs for securely gripping the dowel.

16. The concrete joint restraint system of claim 1 wherein the first and second clips are comprised of injection molded plastic.

17. The concrete joint restraint system of claim 1 wherein the first and second horizontal members comprise upper runners of first and second bolsters, respectively.

18. The concrete joint restraint system of claim 17 wherein the upper runners are supported at the desired height by a vertical support and wherein the means for connection in the first and second clips comprises:

means for gripping the upper runner; and means for stabilizing the clip against the vertical support.

19. The concrete joint restraint system of claim 18 wherein the means for gripping the upper runner comprises an elongated gripping member having a spaced pair of outwardly expandable sides that define an entry gap which leads to an internal aperture sized to fit the upper runner.

20. The concrete joint restraint system of claim 18 wherein the vertical support comprises a pair of inwardly canted legs which meet below the upper runner at an apex to form an inverted-V.

21. The concrete joint restraint system of claim 20 wherein the stabilizing means comprises a pair of spaced side members having angled surfaces that abut the legs when the clip is connected to the upper runner.

22. A concrete joint restraint system that is adapted for securing a dowel to first and second horizontal members that are spaced apart from one another and located at a desired height above a subgrade prior to placement of concrete comprising:

a closed clip including means for receiving one end of the dowel including a cylinder with an end aperture at one end thereof and means for connecting to the first horizontal member; and an open clip including means for receiving the other end of the dowel including a pair of flexible, arcuate side walls having a gap therebetween and means for connecting to the second horizontal member.

23. The concrete joint restraint system of claim 22 wherein the cylinder includes a means for securely gripping the dowel.

24. The concrete joint restraint system of claim 23 wherein the gripping means comprises a plurality of compressible ribs.

25. The concrete joint restraint system of claim 23 wherein the cylinder has a back stop at the other end thereof for limiting the travel of the dowel.

26. The concrete joint restraint system of claim 22 further comprising an end cap which connects to the other end of the cylinder to provide an expansion void.

27. The concrete joint restraint system of claim 26 wherein the cylinder has a back stop at the other end thereof for limiting the travel of the dowel.

28. The concrete joint restraint system of claim 27 wherein the back stop is removable.

29. The concrete joint restraint system of claim 27 wherein the back stop breaks out under expansion pressure.

30. The concrete joint restraint system of claim 22 wherein the arcuate walls include compressible ribs for securely gripping the dowel.

31. The concrete joint restraint system of claim 22 wherein the open and closed are comprised of injection molded plastic.

32. The concrete joint restraint system of claim 22 wherein the first and second horizontal members comprise upper runners of first and second bolsters, respectively.

33. The concrete joint restraint system of claim 32 wherein the upper runners are supported at the desired height by a vertical support and wherein the means for connecting in the first and second clips comprises:

means for gripping the upper runner; and means for stabilizing the clip against the vertical support.

34. The concrete joint restraint system of claim 33 wherein the means for gripping the upper runner comprises an elongated gripping member having a spaced pair of outwardly expandable sides that define an entry gap which leads to an internal aperture sized to fit the upper runner.

35. The concrete joint restraint system of claim 33 wherein the vertical support comprises a pair of inwardly canted legs which meet below the upper runner at an apex to form an inverted-V.

36. The concrete joint restraint system of claim 35 wherein the stabilizing means comprises a pair of spaced side members having angled surfaces that abut the legs when the clip is connected to the upper runner.

37. A concrete joint restraint system adapted for securing a dowel to first and second horizontal members, the system comprising:

a first clip including means for receiving a first end of the dowel, a stop to limit axial travel of the dowel, and means for coupling to the first horizontal member; and a second clip including means for receiving an opposite second end of the dowel and means for coupling to the second horizontal member.

38. The system of claim 37 wherein the stop comprises a back stop.

* * * * *